United States Patent [19]

Sandstrom et al.

[11] 4,270,976

[45] Jun. 2, 1981

[54] METHOD OF PRODUCING PEROXIDE BLEACHED PULP

[75] Inventors: Åke O. Sandstrom, Täby; Bo G. Falk, Järfälla; H. S. Ingemar Bystedt, Daderyd, all of Sweden

[73] Assignee: Defibrator AB, Stockholm, Sweden

[21] Appl. No.: 60,614

[22] Filed: Jul. 25, 1979

Related U.S. Application Data

[63] Continuation of Ser. No. 852,542, Nov. 17, 1977, abandoned.

[30] Foreign Application Priority Data

Nov. 23, 1976 [SE] Sweden ..... 7613088
Mar. 18, 1977 [SE] Sweden ..... 7703137

[51] Int. Cl.[3] ..... D21B 1/16

[52] U.S. Cl. ..... 162/26; 162/28; 162/78

[58] Field of Search ..... 162/26, 28, 23, 78, 162/71; 241/28, 244

[56] References Cited

U.S. PATENT DOCUMENTS

| | | | |
|---|---|---|---|
| 3,388,037 | 6/1968 | Asplund et al. | 162/28 |
| 3,467,574 | 9/1969 | Wost | 162/26 |
| 4,065,347 | 12/1977 | Aberg et al. | 162/26 |

OTHER PUBLICATIONS

"The Asplund Defibrator", Brochure 1946, p. 4, 5, 1941.

Gavelin, Gunnar, "Pulp and Paper International", Jan. 1977.

*Primary Examiner*—William F. Smith

*Attorney, Agent, or Firm*—Eric Y. Munson

[57] ABSTRACT

Method of producing peroxide bleached pulp from fibrous lignocellulose materials which are subjected to a defibration step in a grinding space defined between a pair of discs which rotate relative to one another within a steam pressurized grinding housing. The pulp material is fed into the central portion or "eye" of the grinding space by a screw conveyor which rotates in a bore communicating with the grinding housing to form a steam-tight plug to prevent blow-back of pressurized steam from the grinding housing. The steam-tight plug, upon entry into the central portion of the grinding space, is broken up into fiber bundles which are accelerated radially outwards in the grinding space by the centrifugal force while being subjected to progressively increasing defibrating action. A peroxide-containing bleaching solution is introduced into the grinding space so as to react with the separated fibers of the pulp material during the defibrating action.

7 Claims, 3 Drawing Figures

METHOD OF PRODUCING PEROXIDE BLEACHED PULP

This is a continuation of application Ser. No. 852,542 filed Nov. 17, 1977, abandoned.

BACKGROUND OF THE INVENTION

The present invention relates to a method for the continuous production of pulp from fibrous, lignocellulosic materials by defibering and/or refining the fibrous material between refining discs that are rotatable relative to each other, in a steam atmosphere at an elevated temperature and at a pressure which may be greater or less than atmospheric pressure. The fibrous material is treated in the presence of alkali, and substances are added to the material having a chemical action thereon, such as "per" compounds, especially peroxides, which are used as bleaching agents for their mild effect on lignin. On the other hand, peroxides have a tendency to decompose, e.g. under the influence of heat, and for this reason the effectiveness of the bleaching agent deteriorates when the fibrous material, to which the bleaching agent is added, is subjected to lengthy steam treatment. A lengthy period of steam treatment also makes the fibrous material harder to bleach.

The bleaching of mechanical pulps by means of, e.g., hydrogen peroxide, is thus a known process, but bleaching by this process has hitherto been carried out at temperatures up to approximately 60° C., where the decomposition of the peroxide begins to be appreciable. At temperatures of 100° C. and above, the rate of decomposition is so rapid that effective bleaching in a bleaching tower by conventional methods cannot be achieved. Refiner mechanical pulps have been successfully bleached in a disc refiner at relatively high concentrations, 10% to 20%, in conjunction with so-called post-refining, which requires comparatively little energy, with the result that the rise in temperature is moderate. A disc refiner is a perfect mixer for achieving rapid and thorough blending of the pulp and the liquors, and it does this fairly independently of the concentration of the pulp. The concentration must often be lower than stated above, however, to prevent an injurious rise in temperature.

In consequence of the brief period that the pulp is in the refiner and of the moderately high temperature, approximately 60° C. to 80° C., it is not usually possible to utilize the full bleaching capacity of the peroxide in the refiner, but the pulp must be allowed to stand for a period of time depending on the amount of residual peroxide in the pulp to undergo an after bleaching step after it has passed through the refiner.

In the production of so-called thermomechanical pulps (TMP) with chips in a disc refiner, experiments have been made with adding peroxide to the chips, i.e., feeding in the peroxide via the refiner intake pipe. So far, however, this has had little success, as is confirmed by an article in Pulp & Paper Canada, March 1976, page 63, which, among other things, reports experiments with the addition of peroxide solution in conjunction with pressure defibration, under various conditions, e.g., before and after defibration, in the production of thermomechanical pulp. A summary of results recommends as the best solution the addition of the peroxide solution after the pressure stage, so that the resultant pulp will be bleached under less stringent temperature conditions than those prevailing during the pressure stage. It is probable that earlier attempts to bleach the fibrous material in conjunction with pressure defibration at temperatures above 100° C. have failed to lead to the desired result because of the extremely rapid rate of decomposition of the peroxide, with consequent waste of the bleaching effect. Thus, in the production of bleached pulps of the type in question herein, it has appeared to the expert heretofore that the best procedure is to bleach the pulp in a separate processing stage from defibering, as described above.

OBJECTS OF THE INVENTION

The principal object of the present invention is to provide a method for the continuous production of pulp from lignocellulosic material, where the pulp is bleached in conjunction with the defibration, yet in such a manner that the effectiveness of the bleaching agent is substantially unimpaired.

SUMMARY OF THE INVENTION

According to the invention, the above-mentioned object is achieved by adding the bleaching agent in such a way as to avoid any prolonged action of heat on the bleaching agent before defibration takes place. Thus, the bleaching agent is added to the material to be refined, or to the pulp, immediately before it is introduced between the refining discs, or at some point thereafter. In an embodiment of the invention presented as an example, the substance, such as peroxide, which has a chemical action on the fibrous material, is not added to the fibrous material until the latter enters or is present in the refining zone or the in-feed section to the said zone between the refining discs, and preferably at the moment when the fiber separation has begun.

In an embodiment of the invention, the material to be refined is moreover isolated from the effect of the steam generated during defibration as long as possible before the material is introduced between the refining discs, which is achieved, according to the invention, with the aid of the material itself.

It has been shown in experiments with bleaching in conjunction with defibration of chips in a pressure refiner at refiner temperatures between 100° C. and 150° C., and preferably between 110° C. and 130° C.—through presumably rather higher, 20° C. or more, in the grinding zone—that this method can achieve acceptable results even with a purely alkaline peroxide solution, without stabilizing or buffering additives.

It is evident that the addition of peroxide bleach solution at the moment of defibration will to some extent prevent the formation of chromophores and other substances affecting the color of the pulp that normally occur in the defibration of chips under steam pressure and at temperatures above 100° C., and that the short reaction time achieves a favorable relation between the bleaching action and the decomposition of the peroxide. In comparison with conventional tower bleaching, an extremely short reaction time, such as a fraction of a second, also gives a low alkali consumption, which has a favorable effect on the brightness of the pulp. The high concentration of the pulp, combined with the very effective blending of the bleach liquor, has the further advantage that bleaching can be carried out with a high concentration of peroxide, 10 to 15 g/liter.

The peroxide bleaching agents intended for the purposes of the invention are solutions containing principally peroxides comprising the group of hydrogen peroxide and sodium peroxide, of which the former is the most important and the one most commonly used for bleaching mechanical and certain chemi-mechanical and semi-chemical pulps.

The bleaching process is carried out in the presence of alkali and normally with a bleach liquor containing hydrogen peroxide, stabilized and buffered in a known manner, and optionally containing 3% to 8% sodium silicate ($Na_2SiO_3$) and possibly 0.1% to 0.5% magnesium sulfate ($MgSO_4$), calculated as percentages of the dry lignocellulosic material; but, as mentioned above, the bleaching process has also been carried out with pure hydrogen peroxide, without any buffering substances being present. To achieve a good bleaching result, the lignocellulosic material should be free as far as possible of heavy metallic ions by the addition of complexones, e.g., diethylene triamine penta-acetic acid (DTPA) and ethylene diamine tetraacetic (EDTA), which treatment may take place either before or simultaneously with the bleaching step, in which latter case, the complexones are added to the peroxide bleach liquor. The alkaline environment in which the bleaching takes place is most conveniently obtained by the direction addition of alkaline solution in the refining zone, which can be achieved by mixing the alkaline solution with the peroxide bleach liquor or by adding it separately from but simultaneously with the bleach liquor.

When producing chemi-mechanical pulps from hardwoods, the alkaline environment in which bleaching-/defibration takes place is best achieved by impregnating wood chips with dilute alkali solution, 3 g to 40 g NaOH per liter, at a temperature between 30° C. and 100° C., preferably between 30° C. and 60° C., whereby the finished pulp product, besides brightness can also be endowed with good strength characteristics. Impregnation may be effected by simple diffusion impregnation for 15 to 60 minutes, and also by so-called prex impregnation, in which the chips, after being compressed, e.g., in a screw press, are fed into and allowed to expand in the alkali solution, which is thus soaked up by the chips.

The concentration of peroxide ($H_2O_2$) may vary between 0.8% and 4% calculated in terms of dry fibrous material, but may naturally be either lower or higher depending on circumstances.

The bleached pulps produced according to the invention may be mechanical, chemi-mechanical and semi-chemical pulps produced from fibrous materials of various origins, e.g., softwood, hardwood, bagasse, straw, etc., and also from pulps produced from such materials by defibration under various conditions. In those cases where the lignocellulosic fibrous material is defibered, it is preferable, before defibering, to comminute the fibrous material in known manners to particles of suitable size, e.g., chips, sawdust, or slivers. The fibrous material that is defibered in conjunction with bleaching is also referred to in this application as chips or wood chips.

The bleaching process in question herein is primarily suitable for the production of so-called thermo-mechanical pulps (TMP) by the defibration of chips in a disc refiner at a refiner temperature of 100° C. to 150° C., usually 110° C. to 130° C., in an atmosphere of saturated steam and at a steam pressure, corresponding to the temperature, of between 1 kg/cm$^2$ and 4 kg/cm$^2$. Inside the refining zone, the temperature may locally be considerably higher. Bleaching may be carried out at a high pulp concentration which may be between 25% and 60% after the refining zone.

The bleaching process is also suitable for use in conjunction with the refining of pulps of the type in question herein at high concentrations, 15% to 40%, at which so much energy must usually be supplied for the refining process that the temperatures in a refiner at atmospheric pressure may rise to 100° C., and locally in the refining zone as high as 120° C. to 140° C.

Since the fibrous material consisted of chips, and since the aim has been to produce TMP or chemi-mechanical pulp. the material has been treated in two stages: defibration under pressure at a refiner temperature of 100° C. to 130° C. with continuous addition of bleaching compounds in the grinding zone; and refining at atmospheric pressure in the presence of residual bleaching agent contained in the pulp, the temperature of the output pulp being usually 100° C.

DETAILED DESCRIPTION OF THE INVENTION

Figure 1:
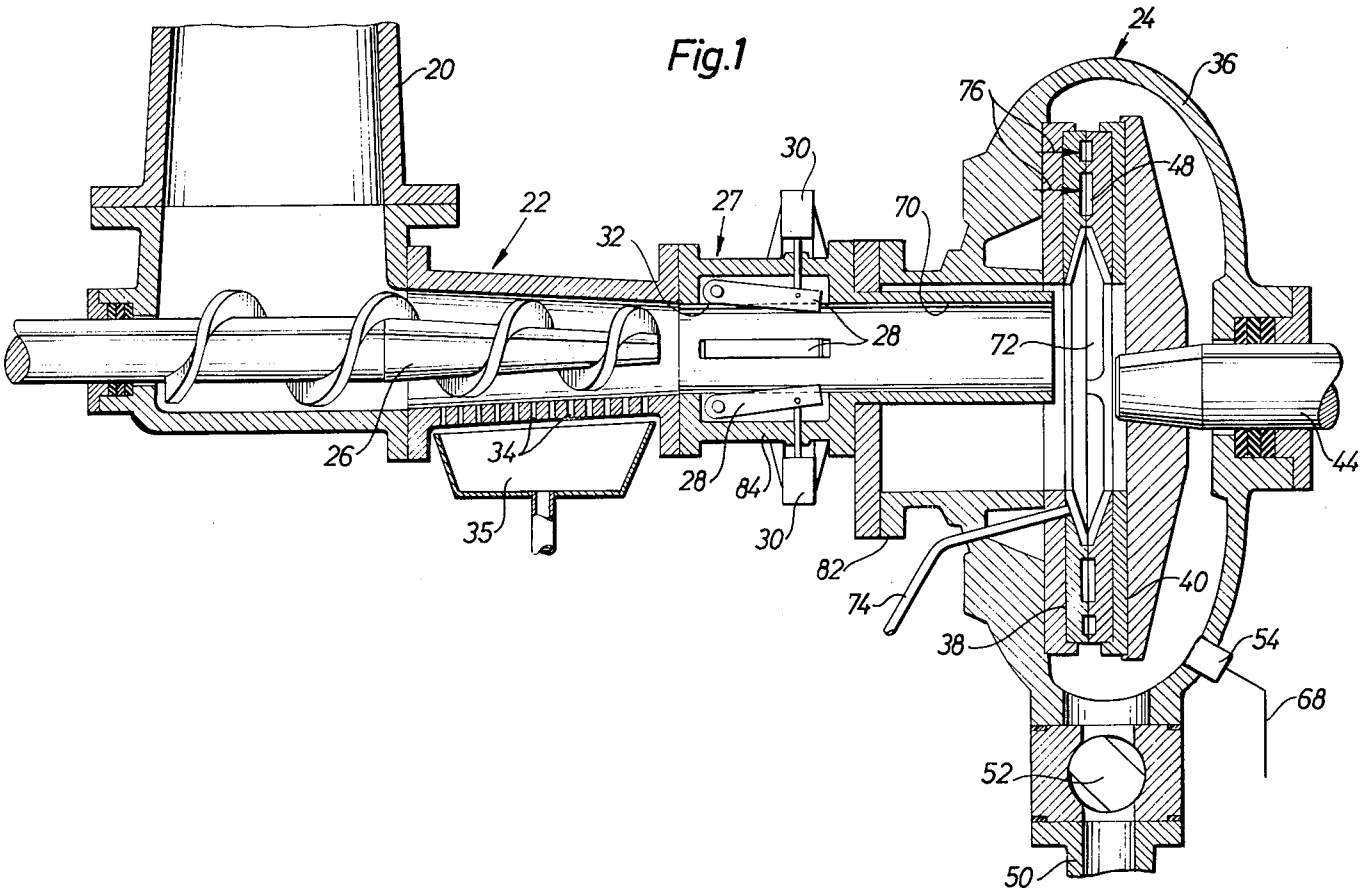
FIG. 1 shows a section through a refining apparatus for carrying out the method of the invention, the bleaching agent being added to the material to be refined immediately before the latter is introduced between the refining discs.

FIG. 1 shows a preferred equipment unit for practicing the method of the invention, comprising a refiner and, connected to the latter, a compressing conveyor for forming a steamtight plug of material.

The starting material, which may be preheated to a temperature not exceeding 100° C., e.g., by the addition of steam, is fed to the intake 20 of the throat 22, in which the material is compressed in order to achieve a steamtight transfer of the material to the refiner or defibrator 24. In the embodiment shown, the throat 22 comprises a conical bore that narrows in the direction of material flow and encloses a rotating conveyor screw 26 of the same conical contour. Connected to the outlet end of the pipe there may be a counter pressure device 27, e.g., in the form of a pipe fitting 84, in which flaps 28 are mounted which are powered by piston servomotors 30 in such a manner that they can be swung into the bore 32 of the pipe fitting, which bore preferably forms a cylindrical continuation of the end of the screw compressor, thus reducing the cross-sectional flow area of this bore. This achieves a high degree of compression of the starting material, e.g., chips. This material usually contains water, which during the compression phase is forced out through perforations 34 in the compressor pipe and is carried away via a funnel 35.

The refiner or defibrator 24 comprises refining discs enclosed in a housing 36, which in the embodiment shown comprises one stationary disc 38 that is rigidly united with the casing, and one refining rotating disc 40 that is carried by a shaft 44 powered by a motor (not shown).

A servomotor (not shown) arranged in a known manner between the motor and the rotating refining disc 40 transmits the pressure of a hydraulic medium, e.g., in the manner disclosed in Swedish Pat. No. 179,337, which corresponds to U.S. Pat. No. 2,891,733, by means of an axially sliding but non-rotatable pressure piston and via shaft bearings to the rotating shaft 44 to generate the requisite high refining pressure on the material flowing radially outwards in the gap 48 between the mutually opposed grinding faces of the refining discs.

Connected to the refiner casing 36 is an outlet pipe 50, comprising a discharge or blow valve 52, for the ground fibrous pulp product. Inside the refiner housing a pressure is maintained which is monitored by a sensing device 54 located inside the housing. The free outflow cross-section of the valve is adjusted with the aid of a servomotor (not shown) in which a piston (not shown) reciprocates which is connected via a transmission (not shown) with a revolving body of the valve 52. The servomotor is supplied with pressure medium through lines which discharge on both sides of the piston and which are connected to a regulator (not shown). The regulator communicates with a pressure medium reservoir and is actuated by the sensing device 54 via a wire 68. By means of this arrangement, a pressure of the desired level above atmospheric pressure can be maintained in the refiner housing 36.

After the starting material has been compressed in the throat 22 and the counter pressure device 27, it advances further through a pipe 70, suitably having a cylindrical bore, the free end of which is located close to the rotating refining disc 40. This pipe is positioned eccentrically with respect to the axis of rotation of the refining disc 40, in order to enhance the breaking up of the highly compressed plug of material before the material is fed into the gap 48 between the refining discs. The plug can be satisfactorily broken up by means of one or more vanes 72 on the refining disc 40 facing the mouth of the eccentric pipe 70. The material is thus so compact when it is forced through the pipe 70 that special means are needed to break up the material to its previous condition. As the starting material is compressed, the water present therein is forced out, with the result that the dry content of the material will rise to 50% or even more. This high concentration is unsuitable for refining, and water is therefore introduced at the interior of the gap 48, e.g., through the stationary refining disc 38 in the refining gap itself, as indicated by the arrows 76. The space between the grinding housing and the bore of pipe 70 in which the steam-tight plug is maintained and advanced towards the vanes 72, is sealed by means of the sleeve 82, to prevent escape of steam.

According to FIG. 1, the chemical treating agents are added immediately before the material is introduced into the gap between the refining discs, e.g., via line 74, whereby it is possible to avoid the steam generated in the defibrating process acting on the agents for any appreciable time and thus impairing their effect.

In the embodiment illustrated, thanks to the steam-tight plug that is formed, the material to be refined will be exposed to the steam only shortly before its entry between the refining discs, which is advantageous in that a short period of steam treatment facilitates the bleaching of the pulp.

It is suitable, when the chemicals are added after the screw, to use a screw conveyor which compresses the fibrous material in order to remove water and air from the pores of the material before it is impregnated with chemicals. When a solution containing the chemicals is added to the compressed material, the liquor will be sucked into the pores upon release of the pressure, so that the fibrous material will be thoroughly impregnated with the chemical solution.

Figure 2:
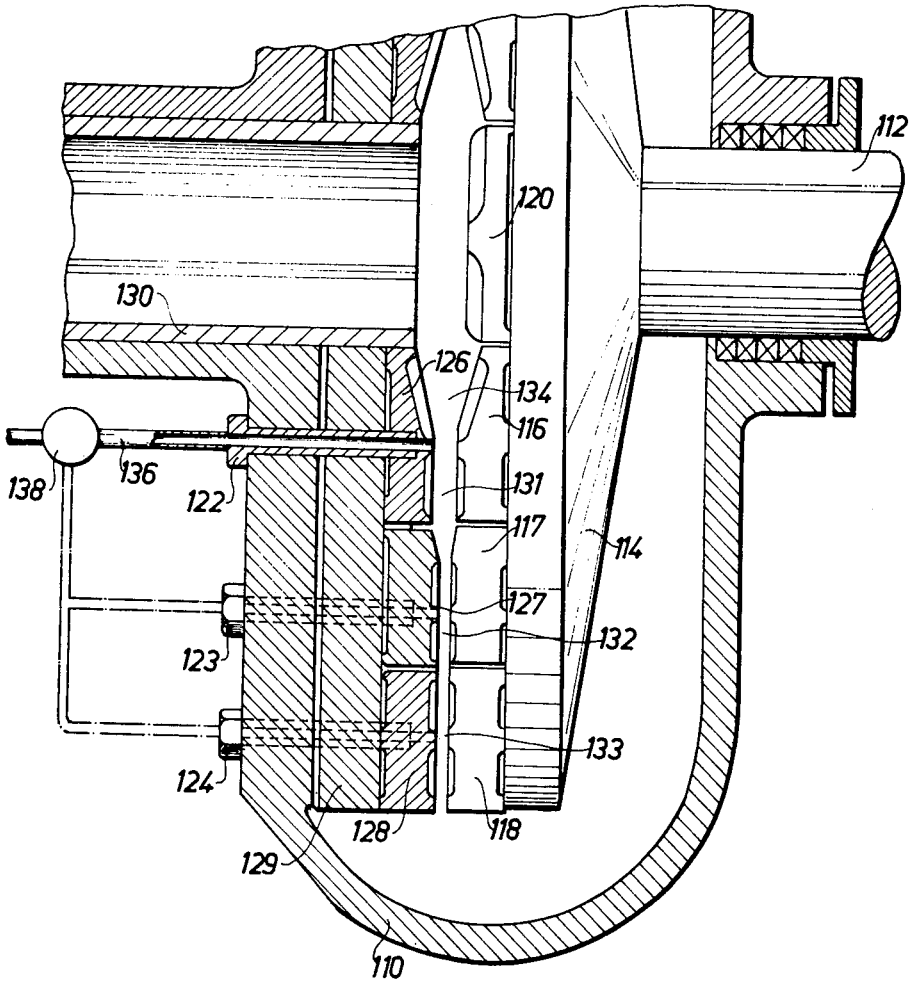
FIG. 2 shows a partial section through a modified version of the refiner, in which the bleaching agent is added in the refining zone.

In the drawing of FIG. 2, 110 denotes a portion of the fixed refiner frame, which comprises a housing and encloses a rotatably mounted shaft 112 carrying a refining disc 114. The refining disc carries a number of concentrically arranged disc segments, in the present case, three segments, 116, 117, 118, which are screwed to the disc 114 around the circumference of the latter. A disc 120 may be positioned in the center to feed the material radially outwards toward the refining gap.

A stationary refining disc usually comprises three concentrically arranged disc segments, 126, 127, 128, which are bolted to a base plate 129 by means of bolts 122, 123 and 124.

The material to be refined, e.g., wood chips or partially comminuted fibrous pulp, is fed into the central portion or "eye" 134 of the refining discs through a central duct 130 in the fixed frame. From here, the material is carried radially outwards between the members of the two refining discs, which define between them a refining gap or grinding space which, in the embodiment presented, comprises three concentric zones, 131, 132, 133, whose width decreases progressively from the innermost zone to the outermost zone.

According to the invention as shown in FIG. 2, the bleaching solution is added at the grinding space, or as closely as possible thereto, via ducts or holes in one of the refiner discs, which is comparatively easy to arrange if, as in the embodiment illustrated, the refiner has one stationary refining disc 129. The segments comprising the refining disc 129 are fixed to the refiner housing by a plurality of bolts 122–124, which extend into the grinding space. A simple and satisfactory manner of introducing the bleaching solution into the grinding space is to bore ducts through one or more of the bolts, and to connect the ducts via tubes such as 136 to a chemical feed pump 138 or other suitable feed system for supplying the bleach liquor. If both discs are rotatable, the ducts in the disc must be connected to a shaft provided with a central longitudinal hole, and further, via a box or similar outside the refiner, to the chemical feed system (not illustrated).

Figure 3:
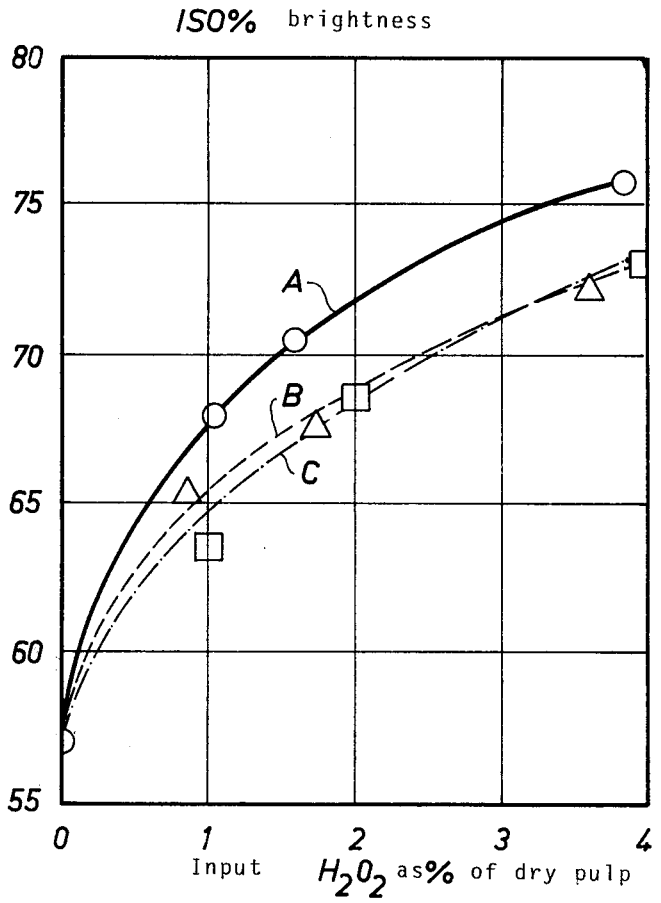
FIG. 3 shows a graph illustrating the relation between the quantity of bleach added and the brightness obtained by the method of the invention and by conventional bleaching methods.

The following examples are presented which illustrate the production of so-called thermo-mechanical fibrous pulp according to the invention under various conditions. For comparison, the defibration step was carried out without the addition of bleach liquor, which, instead, was added in the separate refining step. Furthermore, both defibration and refining were carried out without adding bleach liquor, and the finished pulp product was then bleached in the conventional manner. It was found that, of the pulps produced, the best brightness value was attained by the pulp to which the bleach liquor was added in the defibration step in accordance with the invention. The two pulps produced by other procedures have approximately the same brightness, as appears from FIG. 3, where curve A refers to pulps produced according to the invention, while curves B and C refer to pulps produced, respectively, with bleach added in the refining step and with conventional bleaching of the finished pulp product.

As examples of the quantities of peroxide $H_2O_2$ and other chemicals, percentages of absolutely dry fibrous material, used in the production of TMP from spruce chips by defibration at 1.4 kg/cm$^2$ steam pressure with simultaneous addition of bleach liquor, followed by refining of the pulp in the presence of the retained solution of residual chemicals from the defibration stage, values are presented below from two experiments carried out with different quantities of peroxide.

A. 1.0% $H_2O_2$, 0.6% NaOH, 6.3% $Na_2SiO_3$, 0.6% DTPA: freeness value 60 CSF. Residual peroxide 0.2, pH 7.8, ISO brightness 67.8%.

B. 3.8% $H_2O_2$, 1.3% NaOH, 5.6% $Na_2SiO_3$, 0.5% DIPA: freeness value 60 CSF, Residual peroxide 1.0, pH 7.8, ISO brightness 76%.

As examples of the quantities of peroxide and other chemicals, as percentages of absolutely dry chips, used in the production of chemimechanical pulp from birch wood, some values are presented below from two experiments carried out with different quantities of peroxide and alkali. Bleaching, defibration and refining were carried out to the same schedule as in the preceding experiments.

C. The chips were impregnated with NaOH at 40° C. by "prexing" with an alkali solution of strength 10 g NaOH per liter before defibration, when the chips absorbed 2.8% NaOH.

D. The chips were impregnated with NaOH at 40° C. by "prexing" with an alkali solution containing 3 g NaOH per liter before defibration, when the chips absorbed 0.6% NaOH.

Bleaching liquor:

C. 3% peroxide, 5% $Na_2SiO_3$, 0.5% DTPA, 0% NaOH: refined to freeness value 60 CSF.

D. 4% peroxide, 5% $Na_2SiO_3$, 0.5% DTPA, 2% NaOH, 0.05% $MgSO_4$: refined to freeness value 85 CSF.

Strength characteristics and optical characteristics:

C. Burst index 21.7, breaking length 4150 m, tear index 41, brightness 67%, opacity 85%, light scattering coefficient 420 $cm^2/g$.

D. Burst index 13.1, breaking length 3170 m, tear index 32, brightness 78%, opacity 83.5%, light scattering coefficient 500 $cm^2/g$.

The relatively large difference in brightness despite a comparatively small difference in the quantity of peroxide used is probably due to the difference in the quantity of alkali added when impregnating the chips. When a larger amount of alkali was used a deterioration occurred in the color of the chips which affected the result of bleaching. On the other hand, if alkali is principally added along with the bleach liquor, as in experiment D, this is far from having the same negative effect on the brightness.

In cases where the refined pulp has a high content of residual peroxide, the bleaching chemicals can be partially reclaimed when washing the pulp, and the reclaimed solution freshened up with peroxide and bleaching chemicals and recycled to the defibration stage. A certain amount of peroxide can also be added in the refining stage to further increase the brightness but should in that case be added to the pulp in the refining zone in accordance with the invention.

Thermomechanical pulps which are to be subjected, after defibration, to continuous peroxide bleaching at a high concentration, 15% to 30%, in a disc refiner will rapidly heat up to 100° C., and in the refining zone the temperature can be considerably higher locally. Under these conditions, the bleach liquor containing the peroxide should be added to the pulp in or immediately before the refining zone, according to the invention, whereby the bleaching effect is utilized to the best advantage and loss of peroxide by decomposition is prevented as far as possible. Since the residual peroxide content of the pulp after refining may be high, the pulp should be allowed to stand for between 15 and 60 minutes after refining in order to obtain the greatest benefit from the bleaching capacity of the peroxide.

What is claimed is:

1. In the method of producing peroxidebleached pulp in a defibrating apparatus in which ligno-cellulosic raw material such as wood chips impregnated with a peroxide-containing bleaching solution is disintegrated in a grinding space defined between a pair of grinding discs which discs rotate relatively to one another under axial pressure within a closed defibrator housing in an environment of pressurized steam at a temperature above 100° C., the raw material being compressed at a temperature below 100° C., while being conveyed into an inlet to the defibrator housing and accelerated radially outwards in the grinding space by the centrifugal force created by the rotating discs, the resultant grist being discharged from the defibrator housing through valve means which are controlled to maintain a predetermined pressure within the housing, the improvement comprising:

(a) compressing the raw material into a steam-tight plug at the inlet to said defibrator housing while advancing it into said defibrator housing;

(b) breaking up said steam-tight plug into fiber bundles after said steam-tight plug has entered into said grinding space; and (c) introducing the peroxide-containing bleaching solution into said grinding space without substantial contact with the steam environment in the defibrator housing to react with the raw material during its accelerated radial progression through said grinding space so as to provide a relatively short reaction time betweeen said peroxide-containing bleaching solution and said raw material for achieving a favorable relation between the bleaching action and the decomposition of the peroxide.

2. The method according to claim 1, in which the bleaching solution is introduced into the grinding space at the point where the fiber separation commences in the grinding space.

3. The method according to claim 1, in which the residual bleaching solution accompanying grist discharged from the defibrator housing is utilized to further react with the grist in a second defibrating apparatus under reduced temperature and pressure.

4. The method according to claim 3, in which the grist is reacted with the residual bleaching solution in the second defibrating apparatus at atmospheric pressure and at a temperature less than 100° C.

5. The method according to claim 1, in which the steam environment in the defibrator housing has a temperature ranging between 100° C. and 150° C. and corresponding superatmospheric pressures.

6. The method according to claim 5, in which the bleaching solution is introduced into the grinding space in an amount to impart to the grist discharged from the grinding space a concentration ranging between 25% and 30%.

7. The method according to claim 1, in which the bleaching solution contains peroxide in an amount ranging between 0.8% and 4%, calculated in terms of dry raw material.

* * * * *